United States Patent [19]

Wyslotsky

[11] 4,058,212

[45] Nov. 15, 1977

[54] PACKAGE FOR CONTAINING PRODUCTS

[76] Inventor: Ihor Wyslotsky, 3311 Montmarte, Hazelcrest, Ill. 60429

[21] Appl. No.: 680,087

[22] Filed: Apr. 26, 1976

[51] Int. Cl.[2] ..... B65D 73/00; B65D 45/00

[52] U.S. Cl. ..... 206/470; 229/2.5 R; 206/463; 229/45 R

[58] Field of Search ..... 229/44 R, 45, 2.5; 206/461–471; 220/4 DF

[56] References Cited

U.S. PATENT DOCUMENTS

| | | | |
|---|---|---|---|
| 2,945,586 | 7/1960 | Markes | 206/470 |
| 3,111,220 | 11/1963 | Bostrom | 206/470 |
| 3,351,270 | 11/1967 | Hohnjer | 229/2.5 |
| 3,371,848 | 3/1968 | Ward et al. | 229/45 |
| 3,463,309 | 8/1969 | Szostek | 206/470 |
| 3,552,595 | 1/1971 | Gerner | 229/2.5 |
| 3,741,433 | 6/1973 | Bentley et al. | 229/45 |
| 3,786,982 | 1/1974 | Rakes et al. | 229/2.5 |

FOREIGN PATENT DOCUMENTS

| | | | |
|---|---|---|---|
| 1,352,679 | 5/1974 | United Kingdom | 229/45 |

*Primary Examiner*—William Price
*Assistant Examiner*—Douglas B. Farrow

[57] ABSTRACT

A package is disclosed for a plurality of slices of a meat product in which the slices are arranged in vertically stacked relation on a base member of preformed, transparent plastic sheet material and enclosed by a cover member which is preformed of like material. The base and cover members have peripheral margins which are in flat engagement and sealed under vacuum with a separable seal along three sides enabling the cover member to be hinged about a fourth side in opening the package so as to obtain access to the product without destruction of the package members and having a snap-in latching arrangement for holding the cover member in position upon reclosing the same.

9 Claims, 4 Drawing Figures

PACKAGE FOR CONTAINING PRODUCTS

This invention relates to packaging and is more particularly concerned with an improved package assembly which is especially adapted for the marketing of sliced luncheon meat or similar products.

In the packaging of sliced luncheon meat and similar food products, various package designs have been suggested and a number of different designs have been employed commercially. Generally, the packages found in the market places comprise a relatively stiff member serving as a base for supporting a stack of the slices of the product and a cover member which may be partially or wholly preformed to enclose at least the major portion of the stack and having peripheral flange portions sealed to underlying marginal portions of the base member. A package of this type has generally been accepted in the trade as meeting the principal design objectives which have been to provide an attractive package of a character which will satisfactorily protect the product against damage and rapid deterioration so as to insure adequate shelf life. However, some features of the packages heretofore proposed have not proven to fully serve their intended purpose, particularly, with respect to package rigidity, durability and convenience in use. Many packages have been designed for marketing sliced meat products and a number of them have been employed in large volume commercial operations, including some which are in current use. Most of them lack one or more desirable features generally because it has been difficult to avoid compromises in meeting the sometimes conflicting desires of the distributor and/or the consumer or in attempting to practice maximum economy of materials and labor. It is, therefore, a general object of the invention to provide an improved packaging arrangement, employing minimum labor and materials, which is suitable for packaging a sliced meat product such as sliced luncheon meat or the like, which will adequately protect the product against damage, which will preserve the product against deterioration for a substantial period of time and which provides maximum convenience in use while enabling the package to be formed so as to present an attractive appearance.

A more specific object of the invention is to provide an improved packaging arrangement which is particularly adapted for marketing sliced luncheon meat or similar products, which will provide a container having a support member for a plurality of the product slices in vertically stacked relation and a cover member enclosing the stack, which will enable sealing of the package under vacuum conditions to insure maximum protection against deterioration of the product, which will enable the stack of slices to be viewed without unwrapping, which will permit ready access to the product without destruction of the container forming members and provide maximum convenience in use.

A further object of the invention is to provide an improved package arrangement for sliced meat products which will enable a predetermined quantity of slices of the product in vertically stacked arrangement to be enclosed in a vacuumized compartment formed by sealing the peripheral margins of a preformed, transparent plastic cover member to like margins of a stack supporting base member, which may be also preformed, in such a manner that the cover member may be hinged to an open position, so as to gain access to the compartment for removal of one or more of the slices, and thereafter the cover member may be closed and retained in compartment forming relation, thereby serving to protect any remaining slices of the product in the compartment.

To this end there is disclosed and claimed herein an improved package arrangement for enclosing a plurality of slices of a meat product in vertically stacked arrangement which comprises a preformed transparent plastic base member having a shallow recess in which the stack of sliced product is supported and a preformed, transparent plastic cover member having a deeper recess for mating with the recess in the base member to form a product enclosing compartment, the base and cover members having overlying flange portions which are sealed while the compartment is vacuumized with provision for opening the package to obtain access to the product by breaking the seal and hinging the cover to an open position and with provision for reclosing the cover and securing it in closed position.

The aforesaid and other objects and advantages of the invention will be best understood upon consideration of the preferred form of the package which is shown by way of illustration in the accompanying drawings wherein.

Figure 1:
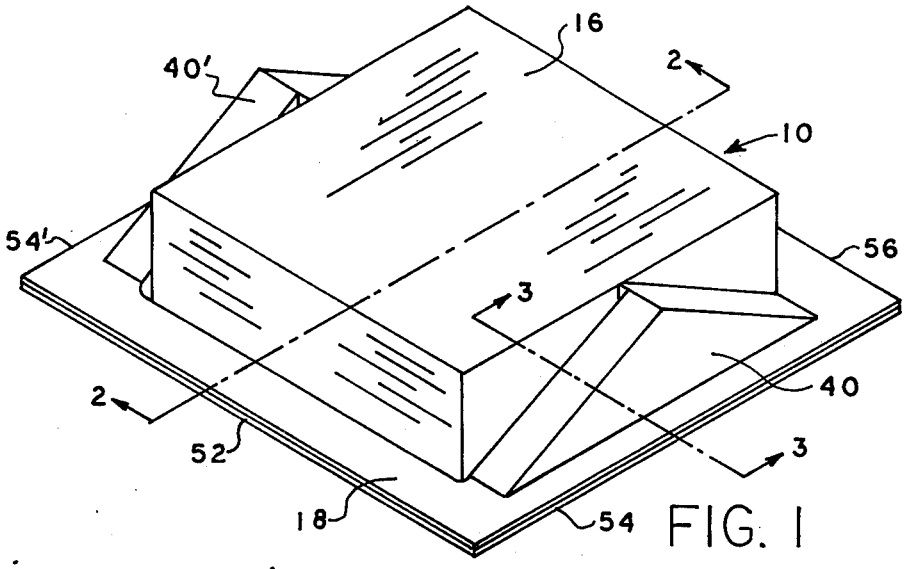
FIG. 1 is a perspective view of a sliced bacon package which incorporates the principal features of the invention.

The package 10, as illustrated in FIG. 1 of the drawing, comprises a base or bottom forming member 12 on which a plurality of slices of a meat product 14 is supported in vertically disposed alignment, with the major portions of the stack thus formed enclosed by means of a top cover member 16 having peripheral marginal portions 18 which are overlying and sealed to mating marginal portions 20 of the bottom member 12. The two container forming members 12 and 16 are formed of a semi-rigid, transparent plastic material and snugly enclose the stack of product slices 14 in a vacuumized compartment while rendering visible through the transparent base and cover members practically the entire outer surfaces of the enclosed product assembly 14.

Figure 3:
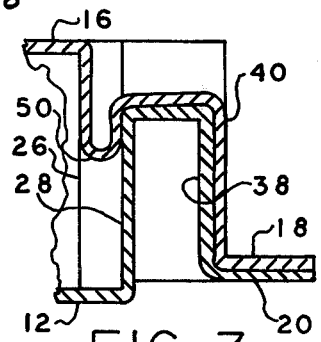
FIG. 3 is a fragmentary cross sectional view, to a greatly enlarged scale, and taken on the line 3—3 of FIG. 1.
Figure 4:
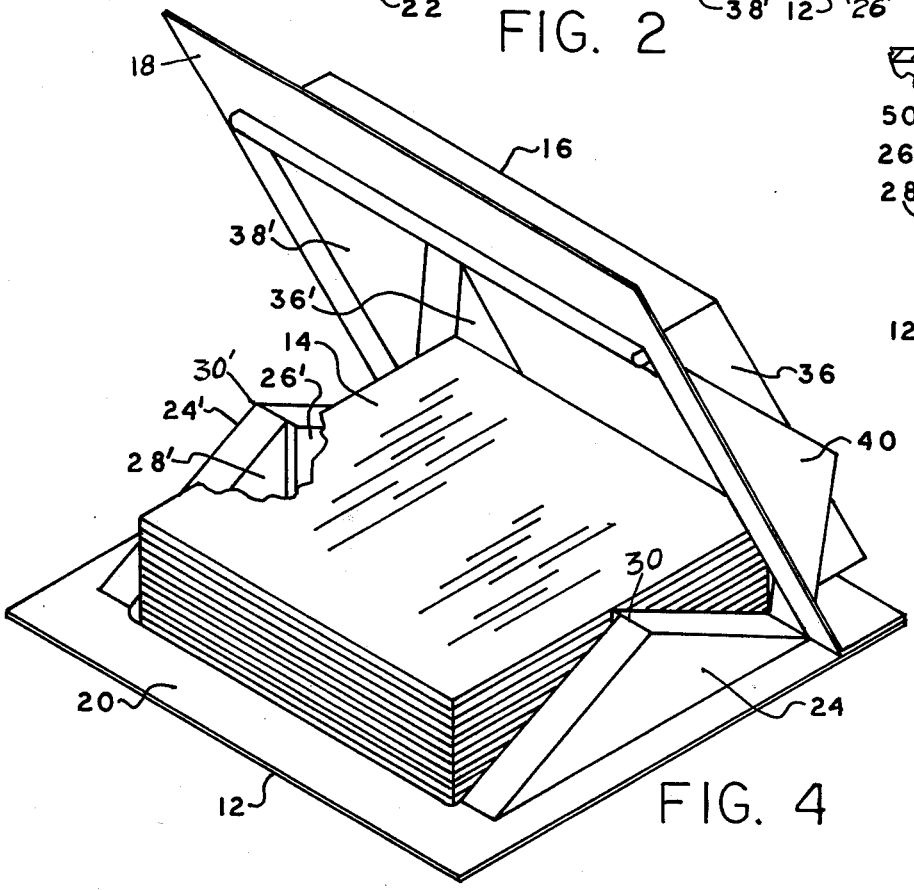
FIG. 4 is a perspective view of the package of FIG. 1 showing the cover member in open position.

The bottom container forming member 12, which serves as a support member for receiving the stack of product slices 14, is approximately square as shown but may be rectangular, depending upon the dimensions and shape of the product slices. The member 12 may be preformed in a known manner from a suitable material having a substantial degree of rigidity, preferably from an impervious plastic sheeting which may be thermoformed. Also, it may be molded or otherwise formed so as to provide a degree of imperviousness sufficient to enable vacuumizing of the package. The member 12 is formed with a shallow recess 22 having the shape of the product slices which, in the form shown, is approximately square. The recess 22 has a depth sufficient to accommodate one or more of the bottommost slices in the stack 14 so as to locate the stack in a definite position on the member. Spaced inwardly of the edges and disposed on opposite sides of the recess 22 there are upstanding, rib-like formations 24 and 24' which are of generally triangular configuration in elevation and which have appreciable width. The rib formations 24, 24' reinforce and rigidify the package and also provide inside vertical wall faces or surfaces 26, 26' which serve to guide the stack 14 when it is deposited in the recess 22 and to confine it on two sides to the recess 22 while holding the individual slices in stacked alignment. The maximum height of the rib formations 24, 24' is approximately the height of the stack of slices 14, the latter being capable of some vertical adjustment in the formation of the package since the meat slices will be, in some degree, compressible. The inside faces or walls 26, 26' have oppositely disposed portions 28, 28' (FIGS. 3 and 4) which are in outwardly offset planes and extend from vertical lines or planes through the peak points 30, 30' of the rib formations 24, 24' to the one side 32 (FIG. 2) of the recess 22, which may be considered the forward or front side of the container, particularly, as it is shown in FIGS. 1 and 4. A marginal flange formation 20 extends about the entire periphery of the bottom member 12, in a common plane, so as to provide a surface area for sealing thereto the marginal flange formation 18 of the cover member 16.

Figure 2:
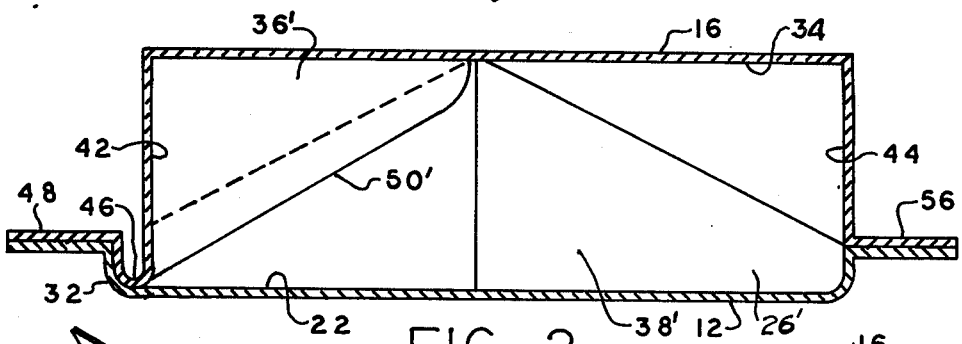
FIG. 2 is a cross sectional view, to an enlarged scale, the view being taken on the line 2—2 of FIG. 1.

The container cover member 16 is preformed from a transparent plastic material which may be the same material which is employed in the bottom member 12 and of the same, or nearly the same gauge, and with a like degree of rigidity. The member 16 is preformed to provide a downwardly opening recess 34 which will have a vertical dimension sufficient to accommodate the upstanding stack of the sliced product 14 when the latter is positioned on the bottom member 12 and which is of a size to mate with, or co-operate with, the recess 22 in the bottom member so as to form a product-receiving compartment or enclosure. Oppositely disposed, vertical side walls 36, 36' define two sides of the recess 34, and have triangular shaped portions 38, 38' disposed in outwardly offset planes which result in rib formations 40, 40' having a triangular shape in elevation and dimensioned so as to overlie the rib formations 24, 24' when the cover member 16 is in package forming position. The other two walls 42 and 44 which define the recess 34 are disposed in parallel, spaced, vertical planes. A marginal flange formation 18, extends about the periphery of the cover member 16 which is coplanar so as to mate with the peripheral flange formation 20 on the bottom member and overlie the latter in the fully closed condition of the package. The front wall portion 42 is provided at the bottom edge with a depending edge portion serving as a latching rib formation 46 which lies at the inner edge of the front marginal flange portion 48 and depends a distance approximating the depth of the recess 22. The latching rib formation 46 is adapted to seat in the area inside the wall portion 32 (FIG. 2) of the recess 22 in the bottom container member 12. Extensions 50, 50' are formed at the opposite ends of the latching rib 46 and extend along the inside top edges of the front portions of the upstanding rib members 40, 40', on the container cover member 16, as shown in FIGS. 2 and 3. The latching rib extensions 50, 50', in the closed condition of the container base and cover mambers 12 and 16, lie along the top margins of the inside face portions 28, 28' of the upstanding rib members 24, 24' of the container bottom or base member 12 and serve to guide the cover member 16 into closed container forming position on the bottom member 12.

In forming the package the stack 14 of the product slices is arranged on the bottom container member 12 and the cover member 16 is positioned over the assembly with the marginal flange portions 18 overlying the flange portions 20 of the bottom container member 12. The flanges 18 and 20 are sealed under vacuum conditions with an adhesive or by a sealing method which will permit subsequent separation of the front flange portions 52 (FIG. 1) and the adjoining side flange portions 54, 54' while retaining the connection or sealed condition along the rear side flange portions 56, thereby enabling the package to be opened by breaking the seal along the three sides and hinging the cover member 16 about the fourth or rear side of the package as shown in FIG. 4. The cover member 16 may be reclosed to protect any of the product which may remain in the product compartment. The latching rib formation 46 and the extensions 50, 50' afford a means for holding the cover member 16 in reclosed condition by frictional engagement with the front side wall 32, which defines the front of the recess 22, and the inside face portions 28, 28' of the bottom rigidifying rib formations 24, 24', respectively. Provision may be made for facilitating the opening of the cover member 16 by providing, for example, a finger grasping tab (not shown) along the front flange portion 52 or a free marginal portion on one of the container flanges for grasping by the fingers in pulling the flange portions apart.

I claim:

1. A container for enclosing a product comprising:

a preformed base member of plastic material having a shallow, upwardly opening, first recess for receiving the bottom portion of the product, said recess being defined by a bottom wall and substantially vertically extending side walls which terminate in a peripheral, horizontally disposed first flange extending about the first recess;

a preformed cover member of plastic material having a downwardly opening second recess and a second peripheral flange for mating with the first recess and said first flange, respectively, so as to form an enclosure for the product and to afford areas on contacting faces of said first and second flanges for sealing the cover member on the base member, said first flange being adapted at one side to be permanently joined to said second flange and being adapted at the other three sides to be sealed so as to permit ready separation for opening the cover and hinging it on said one side;

a latching rib on said cover member along the side of said second flange opposite said one side for seating in frictional engagement in a front portion of the recess in said base member so as to provide for frictionally holding said cover member when it is reclosed;

upstanding, reinforcing rib formations on said base member and extending along opposite sides of the first recess which adjoins the permanently sealed side of the container which rib formations serve in part to confine the product in the first recess; and downwardly opening, reinforcing side wall formations on said cover member which mate with said rib formations and serve to guide the cover into closed position.

2. A container as set forth in claim 1 wherein said reinforcing rib formations on said base member are generally triangular in elevation and extend upwardly to approximately the top of said first recess in said cover member when said cover member is in the closed position.

3. A container as set forth in claim 1 wherein said cover member reinforcing side wall formations have downwardly projecting rib portions which seat along the inside of the reinforcing rib formations on the base forming member and co-operate with said latching rib on said cover member in frictionally holding said cover member in closed position.

4. A packaging container for a product comprising a bottom member of plastic material which is preformed to provide a shallow first recess defined by a bottom wall and substantially vertically extending side walls which terminate in a surrounding, outwardly directed, first flange with upstanding reinforcing and rigidifying rib formations at opposite sides of the first recess, said first recess being of a depth to receive therein bottom portions of said product, said rib formations having inside faces extending upwardly of the edges of said first recess, and a cover member having a downwardly opening second recess of a size to mate with said first recess and co-operating with said first recess in forming a compartment for enclosing said product, said cover member having a second flange surrounding the recess therein, said first and second flanges being arranged to provide co-operating sealing areas with peelable sealing means along three sides and a permanent sealing means along the fourth side which forms a hinge means for swinging the cover member to an open position, said cover member having hollow rib formations at oppositely disposed sides of said second recess which open downwardly and are positioned to encompass the reinforcing rib formations on said bottom member when said cover member is in a closed position.

5. A packaging container as set forth in claim 4 wherein said container cover member and said bottom member have co-operating latching means for frictional engagement when the cover member is closed so as to hold said cover member in closed position.

6. A packaging container as set forth in claim 5 wherein said latching means comprises downwardly extending rib formations of relatively small cross section extending along portions of the sides of the second recess in said cover member and engaging inside faces of the rib formations on said bottom member.

7. A packaging container as set forth in claim 5 wherein said latching means comprises a depending rib formation of relatively small cross section extending along the edge of the recess in said container cover member which is remote from said hinge means, which depending rib formation is positioned to frictionally engage the forward wall defining the first recess in the bottom member when the cover member is in closed position.

8. A packaging container as set forth in claim 5 wherein said latching means comprises a rib formation of relatively small cross section which depends from the inner edge of the cover flange member at the side of the cover which is opposite said hinge means and frictionally engages in the corresponding side of the first recess in the bottom member when the cover member is in the closed position.

9. A packaging container as set forth in claim 5 wherein said latching means comprises a small, depending rib formation extending along the side of the second recess in the cover member which is opposite the hinge means and extensions of said depending rib formation extending along a portion of adjoining sides of said recess which extensions are positioned to frictionally engage inside face portions of said upstanding rib formations on said bottom member.

* * * * *